United States Patent [19]

McCracken

[11] 4,192,234

[45] Mar. 11, 1980

[54] FRAGMENTATION EXPLOSIVE STRUCTURE HAVING ELONGATED FRAGMENTS

[75] Inventor: John McCracken, Dallas, Tex.

[73] Assignee: Vought Corporation, Dallas, Tex.

[21] Appl. No.: 568,646

[22] Filed: Apr. 16, 1975

[51] Int. Cl.[2] ..... F42B 13/48

[52] U.S. Cl. ..... 102/67

[58] Field of Search ..... 102/64, 67

[56] References Cited

U.S. PATENT DOCUMENTS

| | | | |
|---|---|---|---|
| 3,435,762 | 4/1969 | Friedman et al. | 102/67 |
| 3,490,374 | 1/1970 | Nooker | 102/67 |
| 3,722,414 | 3/1973 | Talley | 102/67 |

FOREIGN PATENT DOCUMENTS

| | | | |
|---|---|---|---|
| 1191585 | 4/1959 | France | 102/67 |

*Primary Examiner*—Verlin R. Pendegrass
*Attorney, Agent, or Firm*—James M. Cate

[57] ABSTRACT

An explosive structure of the fragmentation type has a plurality of elongated fragments which are effective against armored targets. The explosive structure has a wall portion extending alongside an explosive charge, the wall portion comprising a plurality of the elongated fragments. The fragments have first and second elongated members or legs which are connected at one end by means permitting rotation of the members from a diverged configuration to an aligned configuration. When in the aligned configuration, the articulated fragment structures are adapted to attain stable, axial flight.

17 Claims, 10 Drawing Figures

FRAGMENTATION EXPLOSIVE STRUCTURE HAVING ELONGATED FRAGMENTS

This invention relates to explosive structures and, more particularly, to explosive structures of the fragmentation type.

Explosive fragmentation structures have usually been of the type adapted to disperse a multiplicity of fragments in a target area, the fragments being ineffective against armored targets such as tanks, armored vehicles, or gun emplacements. More sophisticated, shaped charge warheads are effective against heavy armor, but they are not conveniently adapted for use in fragmentation warheads and thus must normally be precisely directed to a particular target. In the past, it has been attempted to develop fragmentation weapons which would be effective against armored targets by employing fragments of elongated configuration, such as metal rods or bars. By the use of elongated fragments, the penetrating force against a target can be greatly increased in the event the fragment impinges axially upon the target, in that the kinetic force per unit of cross-sectional area is much greater than that in the case of a fragment of approximately uniform dimentions. Such forces can be sufficient to penetrate several inches of armor.

The latter approach introduces problems of its own, however, in that unless the elongated fragments are stabilized during flight, only a small percentage of the fragments will be moving axially at any given time. This, of course, lessens the effectiveness of the warhead, and to achieve a given probability of damaging a target at a given range from warhead to target, a warhead having a substantially greater number of fragments must be provided than would be the case if all the fragments attained axial flight, with resultant increase in size and weight of the warhead. Axial flight may ultimately be achieved if the fragments are provided with stabilizing airfoils such as rear fins, but the initial flight may be unstable unless the fragments are initially arrayed with their axes extending radially from the effective center of the explosive charge. Such instability during the initial flight from the warhead, when a fragment may be travelling transversely of its axis or may be oscillating about its yaw and/or pitch axes, may result in a substantial and undesirable loss of velocity. Because the momentum of a moving body is proportional to the square of its velocity, relatively small increases in velocity result in substantial losses of energy. If, on the other hand, the fragments are oriented with their axes extending perpendicularly from the explosive charge, the explosive forces will be exerted against the end portions of the fragments, which have less area to receive the forces than do the sides of the elongated fragments, thus requiring substantially greater explosive induced pressures to exert a given degree of accelerative force against the fragments. It would thus be a significant advance in the art if an explosive structure could be constructed wherein the explosive forces are directed against side surfaces of elongated fragment structures, but wherein the fragments are adapted to assume quickly a stable, axial flight mode following detonation.

It is, accordingly, a major object of the present invention to provide a new and improved, fragmentation explosive structure having elongated fragments effective against armored targets.

Another object is to provide such an explosive structure in which the respective fragments receive explosive forces directioned transversely of elongated portions of the fragments, but wherein the fragments are adapted to attain stable, axial flight within a few feet of flight following detonation of the explosive.

A further object is to provide such an explosive structure in which the fragments comprise articulated structures each having relatively large, force receiving areas initially facing toward the explosive charge, but wherein the respective articulated structures are adapted to attain a converged, elongated configuration to minimize drag during subsequent, axial flight.

Yet another object is the provision of such an explosive structure wherein substantially all of the articulated structures attain axial flight, whereby there is no need to deploy an excessive number of elongated fragments to compensate for those which may be travelling in a non-axial orientation upon impact with the target in order to obtain a given probability of axial impact with the target.

Other objects and advantages will be apparent from the specification and claims and from the accompanying drawing illustrative of the invention.

Figure 1:
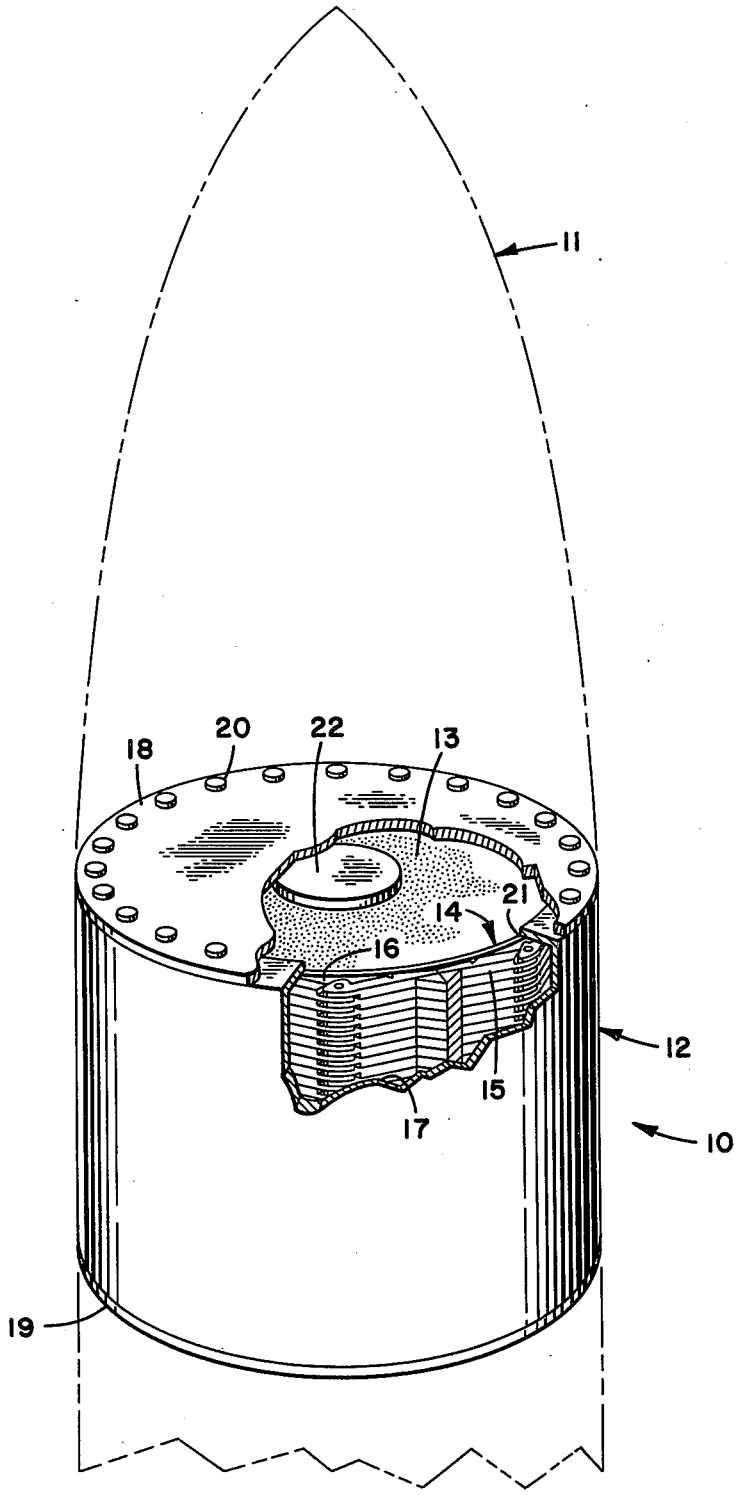
FIG. 1 is a diagrammatic representation of a missile in which is mounted a warhead structure constructed according to one embodiment of the present invention, the warhead structure having portions broken away for clarity.

With initial reference to FIG. 1, an explosive structure constructed according to one embodiment of the present invention comprises a cylindrical, fragmentation warhead 10 installed axially in the forward portion of a missile 11 of the ground-to-ground type. The warhead 10, in the present embodiment, has a cylindrical housing 12 containing an explosive charge 13, suitably a mixture of trinitrotolune and cyclotrimethylenetrinitramine or the like. The housing 12 includes a fragmentable wall structure or wall portion 14 which, in the present embodiment, is cylindrical and extends axially of the missile 11. With additional reference to FIG. 5, the fragmentable wall structure 14 comprises a plurality of articulated structures or projectiles 15, to be described more fully hereinafter, which are separably constrained in a cylindrical array by means preferably comprising a plastic matrix 16 (FIG. 6) in which the articulated projectiles 15 are embedded, as will also be more fully described. Referring again primarily to FIG. 1, the fragmentable wall structure 14 includes an outer, cylindrical jacket or skin 17, suitably of aluminum sheet material, which is contiguous at its end portions with the outer skin of the missile 11. The wall structure 14 is closed at both ends by forward and aft end walls 18, 19. The forward end wall 18 is fastened to the forward end of the outer jacket 17, suitably by being bolted as at 20, or otherwise affixed, to a radially inwardly projecting flange 21 extending along the upper end portion of the outer jacket 17; the aft end wall 19 is suitably welded to the outer jacket 17 at its aft end. A detonating charge 22 is mounted centrally of the housing 12 adjacent the forward end wall 18 for initially activating the explosive charge 13, according to practices well-known in the art. Suitable, proximity sensing actuator and fusing means, not shown, are preferably provided for activating the detonating charge 22 upon the missile 11 descending to a predetermined height, such proximity sensing and fuze means also being known in the art. The outer jacket 17 suitably constitutes the outer skin of the missile 11 adjacent the warhead 10, and the warhead is connected to the remaining portions of the missile by any suitable means. As an example, peripheral flanges, not shown, may be affixed to the end walls and projected axially of the missile for facilitating bolting of the end walls to adjacent portions of the missile.

Figure 2:
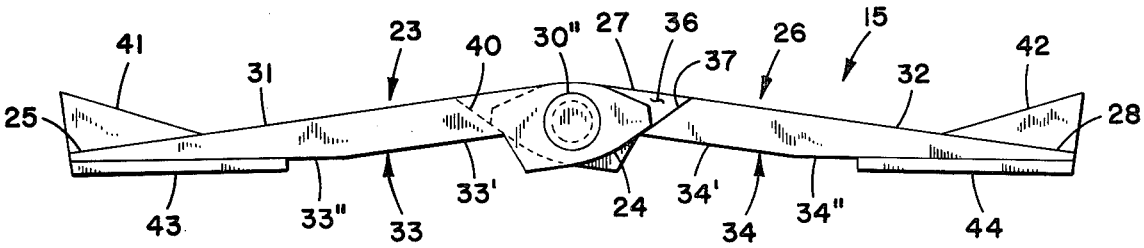
FIG. 2 is an enlarged, longitudinal view of one of the articulated projectiles of the warhead structure of FIG. 1 taken in a plane perpendicular to the pivotal axis of the projectile, the projectile being shown in its diverged configuration.

With reference now to FIG. 2, one of the articulated projectiles 15 is shown in greater detail. The projectile 15 includes a first elongated member 23 having first and second end portions 24, 25 and a second, similar elongated member 26 having first and second end portions 27, 28. The respective first end portions 24, 27 of the first and second elongated members 23, 26 are interconnected by articulatory means permitting rotation of the elongated members from a diverged configuration, in which their respective end portions 25, 28 are mutually spaced, to an aligned configuration (FIGS. 3 and 4), in which their respective end portions are mutually adjacent and in which the first and second elongated members are substantially parallel, the first end portions 24, 27 comprising the forward end of the projectile. In the preferred embodiment, the articulatory means constitutes means pivotally connecting the elongated members 23, 26, suitably a pivot pin 30 pivotally connecting the first end portions 24, 27 of the two elongated members 23, 26, although in an alternative embodiment, not shown, other articulatory connecting means, such as strip of flexible metal, are employed.

Figure 4:
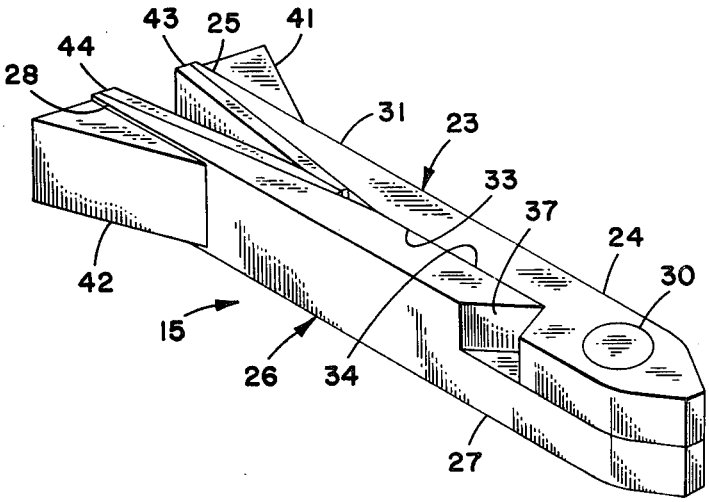
FIG. 4 is a longitudinal view of the articulated projectile in its aligned configuration, taken in a plane parallel to its pivotal axis.

In the illustrative embodiment, each elongated member 23, 26 is of approximately rectangular cross-section. The first and second elongated members have respective outer side surfaces 31, 32 which face outwardly from the explosive charge 13 (FIG. 1) when the articulated projectiles 15 are arrayed in their diverged configuration adjacent the explosive charge, and they have oppositely facing, force receiving, inner side surfaces 33, 34 which face inwardly of the housing 12 (FIG. 1) toward the explosive charge. The side surfaces 31, 32, 33, 34 are generally parallel to the axis of the pivot pin 30. Referring now to FIG. 4, the first end portion 24 of the first elongated member 23 is preferably configured as a leaf of rectangular cross-section which extends forwardly from one side of the remainder of the first elongated member, the other side of the first end portion 24 being cut away to define a planar, side bearing surface 35 which extends forwardly perpendicularly of the axis of the pivot pin 30. Similarly, the first end portion 27 of the second elongated member 26 is configured as a leaf of rectangular cross-section having a side bearing surface 36 confronting and slideably or movably associated with the side surface 35 of the first elongated member 23. The pivot pin 30 is suitably formed with a head portion 36 (FIG. 4) at one end, which portion is rotatably seated within a corresponding cavity in the first elongated member 23, the remainder of the pin 30 extending rotatably through the first elongated member and non-rotatably through the second elongated member 26 whereby the first elongated member is permitted to rotate about the pin 30 relative to the second elongated member. Referring now to FIG. 2, the portion of the second elongated member 26 which is cut away to form the planar bearing surface 36 is cut diagonally forwardly, from the outer surface 32 to the inner surface 34 of the elongated member 26, to define a canted surface 37 extending along a plane perpendicular to the axis of the pivot pin 30. As shown in FIG. 2, the first or forward end portion 24 of the first elongated member 23 is narrowed toward its forwardmost end, the inner and outer side surfaces 33, 31 converging in the forward direction, and the converged, forwardmost end extends over and rests against the canted surface 37 when the articulated projectile is in its diverged configuration, as shown in FIG. 2. Accordingly, the canted surface 37 serves as a stop for preventing pivotal movement of the first elongated member in the outward direction, i.e., that toward which its outer side surface 31 is facing, beyond the diverged position of FIG. 2, wherein the members 23, 26 are somewhat canted to extend tangentially of the explosive charge 13 (FIG. 1). The first elongated member 23 similarly has a canted surface 40 (FIG. 4) against which the first end portion 27 of the second elongated member 26 is brought into contact when the first end portion 24 of the first elongated member 23 is in contact with the canted surface 37, the elongated members 23, 26 being substantially identical in construction.

In the preferred embodiment, first and second airfoil structures 41, 42 are affixed to and project outwardly from the outer surfaces 31, 32 of the first and second elongated members 23, 26, respectively, adjacent the second end portions 25, 28 of the members. The airfoils 41, 42 are preferably wedge shaped, i.e., substantially rectangular in cross-section and triangular in longitudinal section, and their outer surfaces extend diagonally outwardly and rearwardly from the outer surfaces 31, 32.

The airfoils 41, 42 are preferably of hollow construction whereby they do not substantially increase the weight of the rear end portions 25, 28 of the elongated members 23, 26. The articulated projectile 15, in its aligned configuration, is thus constructed with its longitudinal center of gravity positioned forwardly of its longitudinal center, the elongated members 23, 26 being tapered toward their rear end portions 25, 28 as will now be described. Referring to FIG. 2, the inner side surfaces 33, 34 of the first and second elongated members 23, 26 suitably have respective forward surface portions 33', 34', which extend parallel to the outer surfaces 31, 32, and respective rear surface portions 33", 34" which extend rearwardly from the respective forward surface portions 33', 34' and diagonally toward the outer surfaces 31, 32.

Figure 3:
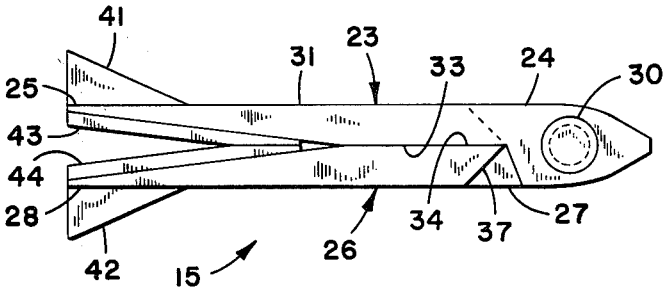
FIG. 3 is a perspective view of the articulated projectile of FIG. 2 in its aligned configuration.

The first and second elongated members 23, 26 preferably have respective bodies, e.g., strips 43, 44, of a deformable material affixed to the elongated members 23, 26 on the rear surface portions 33", 34" and projecting therefrom, the outer surfaces of the deformable strips 43, 44 thus comprising raised portions of the force receiving, inner surfaces 33, 34 of the first and second elongated members 23, 26. The strips 43, 44 of deformable material are suitably of a ductile material such as aluminum, the remainder of the elongated members 23, 26 preferably being of steel. The deformable strips 43, 44 project from the elongated members 23, 26 sufficiently to contact one another, as the elongated members 23, 26 are rotated toward each other, before the forward surface portions 33', 34' are brought into contact, whereby the strips 43, 44 are brought into mutual contact as shown in FIG. 3. The deformable material is alternatively applied to only one of the elongated members 31.

Figure 5:
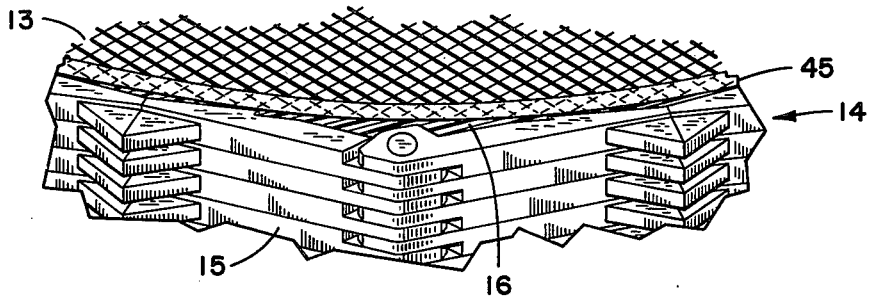
FIG. 5 is an enlarged, perspective view of a portion of the fragmentable wall structure shown in FIG. 1.

With reference now to FIG. 5 and as outlined initially with respect to FIG. 1, the fragmentable wall structure 14 comprises a plurality of the articulated projectile structures 15 supported in an array in which the respective force receiving, inner surfaces 33, 34 (FIG. 2) are facing toward the explosive charge 13. In the preferred embodiment, the plastic matrix 16 is employed both to constrain the articulated projectiles 15 in appropriate alignment and to dampen and distribute the initial forces exerted against the projectiles upon detonation of the explosive charge 13. The fragmentable wall structure 14 is conveniently constructed by initially stacking the articulated projectiles 15 one upon the other in a cylindrical array extending circumferentially around an inner, cylindrical liner 45, suitably of lightweight fibrous material. With added reference to FIG. 6, a quantity of an uncured plastic material, suitably an epoxy resin with a curing agent, is then introduced between the inner liner 45 and the outer, aluminum jacket 17. Upon curing, the epoxy resin thus forms a plastic matrix 16 which initially constrains the articulated projectiles 15 in an array bordering the explosive charge 13. The articulated projectile structures 15 are thus constrained, in their diverged position, in a configuration in which their force receiving, inner side surfaces 33, 34 face toward and extend approximately tangentially of and alongside the explosive charge 13.

Figure 6:
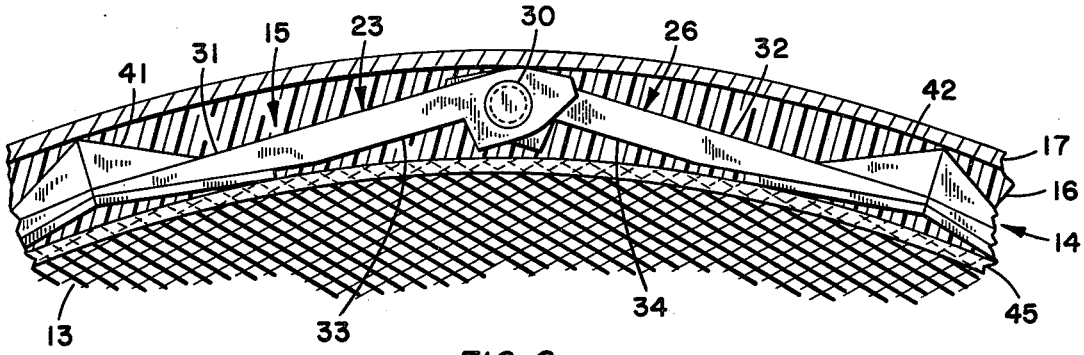
FIG. 6 is a cross-sectional view of the fragmentable wall structure of FIG. 5 taken on a plane perpendicular to the longitudinal axis of the warhead structure.

In operation, the missile 11 is propelled toward an armored target and suitably caused to attain a trajectory in which the missile is travelling downwardly as it approaches the target area. As previously discussed, proximity sensing actuation and fuze means, not shown, are employed according to practices known in the art for actuating the detonating charge 22 upon the missile 11 descending to a predetermined height, e.g., between ground level and 15 feet, adjacent a target. Detonation of the detonating charge 22 then produces detonation of the main charge 13, the resulting, explosive produced pressures against the fragmentable wall structure 14 quickly reaching levels of thousands of pounds per square inch. Referring to FIG. 6, because the plastic matrix jacket 16 contains no fibrous reinforcing material, it has relatively little tensile strength and is shattered into particulate matter as the explosive forces are exerted against the wall structure 14. The matrix 16 is thus a means separably constraining the projectiles 15 in the initial array. However, the matrix 16 tends to evenly distribute the explosive forces to the articulated projectiles 15 over their entire length and to dampen somewhat the effect of the initial shockwave. Absent the plastic matrix 16 included in the preferred embodiment, the initial shockwave would impact sharply and directly against certain portions of the projectiles 15 before reaching other portions thereof, possibly resulting in deformation of the projectiles or in deflection of the projectiles into an instable flight mode.

As the explosive forces react against the matrix 16 and the articulated structures, pressures are applied to the inner, force receiving surfaces 33, 34 of the elongated members 23, 26 of the articulated projectiles 15, causing the projectiles to be propelled radially outwardly at high velocities. Initial velocities of several thousand feet per second have been attained. While the initial, outward displacement of each projectile 15 occurs as it is in its diverged configuration, when the momentum of the projectile carries it beyond the area in which substantial explosive forces exist, the airflow reacting against the outer surfaces 31, 32 of the elongated members 23, 26 serves to urge the elongated members 23, 26 together, quickly pivoting the members about pivot pin 30 until the articulated projectile is brought into its aligned, axial configuration. This occurs because, as previously discussed, the elongated members 23, 26 preferably are initially swept rearwardly from a plane intersecting the pivot axis through pivot pin 30 and extending tangentially of the cylindrical wall portion 14 and because, in the preferred embodiment, the longitudinal centers of gravity of the respective elongated members 23, 26 are positioned forwardly of their longitudinal midpoints, whereby the center of gravity of the articulated projectile in its aligned position is forward of its midpoint. Additionally, the airfoils 41, 42, with their diagonally outwardly and rearwardly extending outer surfaces, serve to react with the adjacent airflow to urge the elongated members 23, 26 into the aligned position. The outer surfaces 31, 32 of the elongated members 23, 26 thus comprise means responsive to adjacent airflow during outwardly propelled flight for rotating the elongated members of the respective articulated structures into their aligned position for permitting axial, inertial flight of the projectiles. Alternatively, the elongated members 23, 26 are constructed with their outer surfaces 31, 32 having larger areas, not shown, toward the rear end portions 25, 28, which configuration also serves to urge the members into their aligned position.

Accordingly, because of the initial alignment of the articulated projectiles 15 in the fragmentable wall structure 14, the projectiles are propelled radially outwardly into initial, axial flight. That is, the plastic matrix 16 separably constrains the projectile structures in a symmetrical array in which they extend peripherally of the explosive charge, along a cylindrical locus circumferential of the explosive 13, whereby the expanding explosive forces urge the projectiles radially outwardly along respective trajectories which coincide with the initial axial orientation of the projectiles. The matrix 16, in the illustrative, cylindrical embodiment, separably constrains the projectiles 15 in mutually contiguous alignment along the axial length of the cylindrical wall 14, with the axes of the pivotal connections 30 extending parallel to the axis of the housing 12 (whereby the radially expanding forces are directed against the projectiles perpendicularly of their pivotal axes and thus tend to urge the projectiles outwardly in a stable, axial flight along a trajectory perpendicular to the pivotal axes of the projectiles). In the preferred embodiment, the pivotal axes of the projectiles which are initially mutually contiguous along the length of the cylindrical housing 12 are also in substantial mutual alignment, whereby the elongated members of mutually adjacent projectiles are contiguous and whereby their inner surfaces 33, 34 are in contiguous, side-by-side parallel alignment alongside the explosive charge, whereby substantially all the expanding gasses are initially directed against the inwardly facing surfaces 33, 34 rather than being lost through gaps in the wall structure 14. For the same reason, the projectiles 15 are also constrained, by the matrix 16, with the member end portions 25, 28 of circumferentially mutually adjacent projectiles 15 in contiguous, axial alignment, extending in planes substantially perpendicular to the housing axis, to form lengths of mutually adjacent elongated members extending circumferentially of the explosive charge 13.

While the cylindrical wall structure 14 is thus effective when dispersion of fragments over a wide area is desired, other configurations are also advantageous for other applications, as will be discussed more fully hereinafter. While the use of a plastic matrix 16 is preferred as a means for initially separably constraining the articulated projectiles 15, other means may also be employed. For example, the projectiles 15 may be initially separably constrained in a desired position by inner and outer liners or jackets such as the liner 45 and the aluminum jacket 17.

Referring to FIGS. 2 and 3, the canted stop surfaces 37, 40 and the extended forward end portions 24, 27 cooperate to prevent outward pivotal movement of the members 23, 26 during their initial, outward flight, following which the members are quickly brought into the aligned position of FIGS. 3 and 4. If the members 23, 26 are constructed of steel or other material having resilient properties, the sudden impact of the two members 23, 26 in flight could be followed by a reactive motion or rebounding of the members from the aligned position, resulting in oscillatory relative movement of the members during flight which would retard the outward flight of the projectile. To avoid this effect, the deformable strips or bodies 43, 44 are preferably applied, whereby the strips 43, 44 meet and are deformed, as illustrated in FIG. 3, before the members are brought into their fully aligned position, thus cushioning and damping the mutual impact of the members.

To summarize, the articulated projectile 15 is propelled radially outwardly and quickly brought into the aligned position, in which it is initially oriented for axial flight. The outwardly projecting airfoil structures 41, 42 serve to stabilize the projectile in axial flight by creating a somewhat increased drag toward the rear of the projectile and by reacting with adjacent airflow if the projectile should deviate from its axial flight. That is, should the projectile 15 rotate about its yaw axis, i.e., a transverse axis parallel to the pivot axis through pivot pin 30, the surface defined by the diagonal, outer surface area of the airfoil 41 or 42 which is then pivoted outwardly into the airflow reacts therewith to bring the projectile back into axial flight. During axial flight, the diagonal, outer surfaces of both airfoil structures 41, 42 react against the adjacent airflow to maintain the members in their aligned position. Should the projectile deviate about its pitch axis, i.e., a transverse axis perpendicular to the yaw axis, the contiguous side surfaces of both airfoils 41, 42 which side surfaces are then moved outwardly into the adjacent airflow react therewith to bring the projectile back into axial flight. The airfoils 41, 42, by their wedge shaped configuration of rectangular cross section, thus serve both to maintain the articulated projectile 15 in its aligned position during flight and to stabilize the projectile in axial flight.

Figure 7:
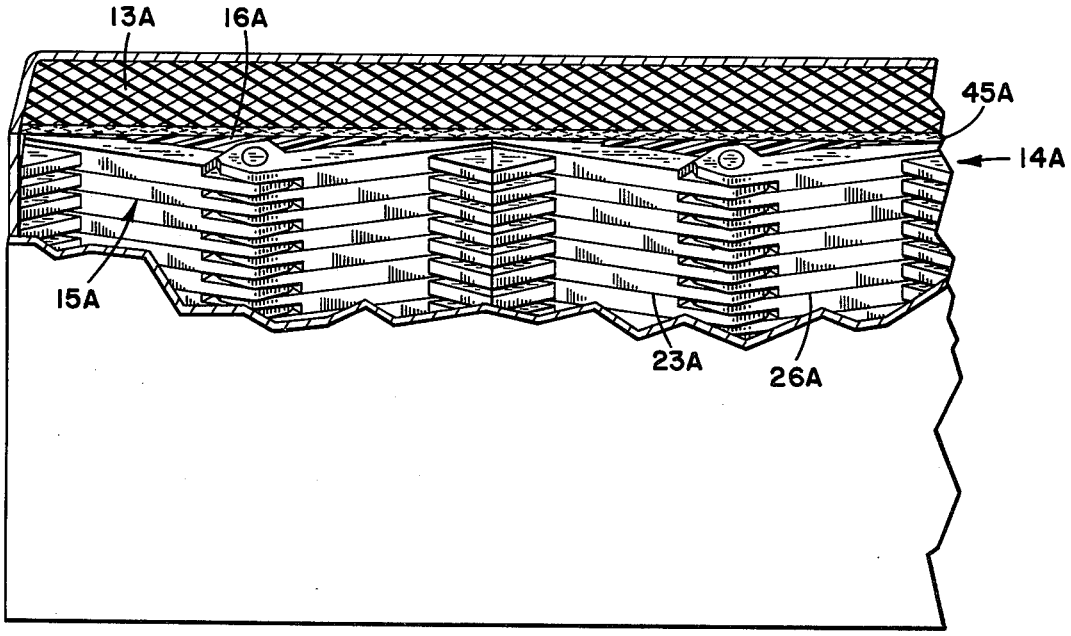
FIG. 7 is a perspective view, similar to FIG. 5, of another embodiment of the fragmentable wall structure.
Figure 8:
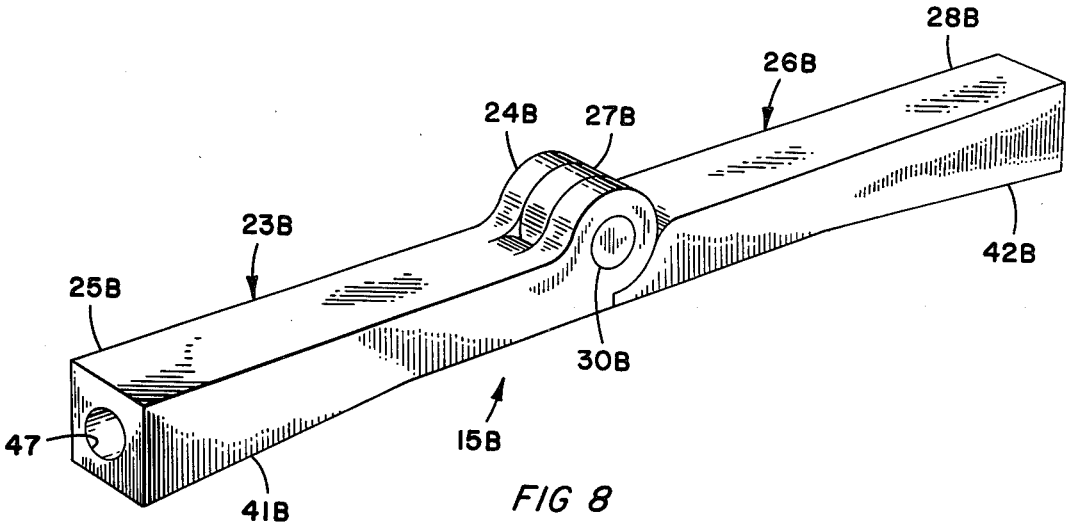
FIG. 8 is a perspective view of another embodiment of the articulated projectile, the projectile being shown in its diverged configuration.
Figure 9:
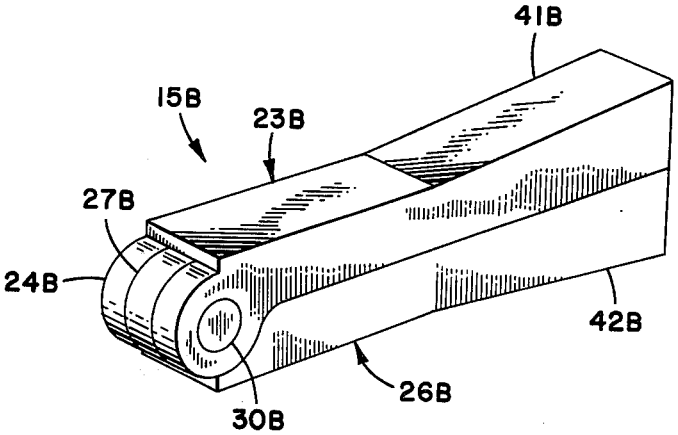
FIG. 9 is a perspective view of the projectile structure of FIG. 8 in its aligned configuration.
Figure 10:
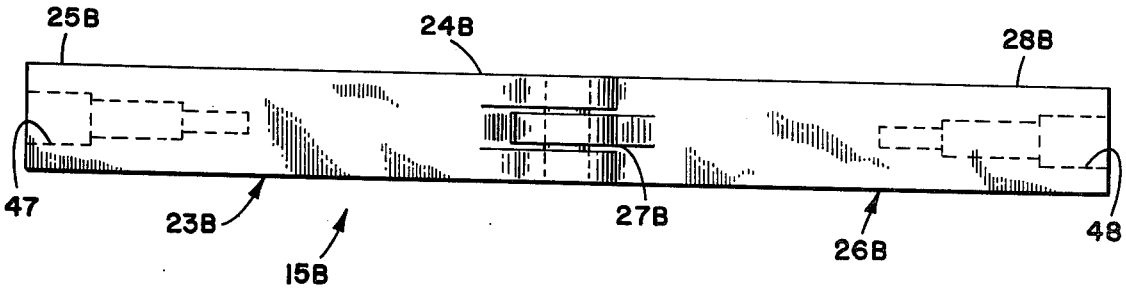
FIG. 10 is a top-plan view of the projectile structure of FIGS. 8 and 9 in its diverged configuration.

As suggested earlier, while the cylindrical, fragmentable wall structure 14 is effective to provide an effective dispersion of projectiles along trajectories extending radially outwardly from a central axis, other wall configurations are also effective for other applications. Referring to FIG. 7, for example, a plurality of the articulated projectiles 15A are constrained by a plastic matrix 16A in mutually contiguous alignment but in a planar rather than cylindrical array wherein the projectiles are coincident with a common plane. The adjacent, inner liner 45A is also of planar array, bordering the explosive charge 13A which itself is suitably of a planar configuration. The explosive charge 13A is suitably of a thickness of, for example, of approximately 3.50 inches if the elongated members 23A, 26A are 0.81 inches in thickness. The projectiles 15A of the planar fragmentable wall portion 14A are propelled outwardly upon detonation of the explosive charge 13A as in the first embodiment, but they are propelled along substantially parallel trajectories perpendicular to the planar wall portion 14A rather than upon radially diverging trajectories. Accordingly, the planar wall structure 14A of FIG. 7, when directioned toward a particular target, is effective to propogate the projectiles 15A toward the selected target rather than outwardly in a circular array, whereby a concentrated projectile pattern is directed against the target. In further embodiments, not shown, the fragmentable wall structure is formed in various other configurations to achieve other dispersion patterns. In alternative embodiments, not shown, a plurality of fragmentable wall portions may be employed as wall portions of a single fragmenting warhead, as at side and end portions thereof. Referring now to FIGS. 8, 9 and 10, a somewhat modified embodiment of one of the articulated projectiles is shown as 15B, the modified embodiment being adapted to withstand great accelerative forces, and thus being particularly adapted for applications wherein great explosive charge-to-mass ratios are employed to obtain high projectile velocities. The first end portion 24B of the first elongated member 23B is bifurcated, having two parallel leaves, and the first end portion 27B of the second elongated member 26B is interdigitated between the two leaves of the end portion 24B, the end portions 24B, 27B being pivotally connected by a transverse pivot pin 30B. This modification provides greater resistance to forces tending to deform or twist the two elongated members 23B, 26B. The first and second airfoil structures 41B, 42B are formed as integral portions of the elongated members 23B, 26B for increased strength, and the second end portions 25B, 28B have respective cavities 47, 48 drilled axially therein for reducing the mass of the second end portions 25B, 28B.

It can thus be understood from the above description that the present invention provides an improved fragmentation structure which is effective to propel elongated projectiles axially against armored targets whereby the kinetic energy of each elongated projectile is exerted against a relatively small area of the target in order to achieve penetration thereof. The fragmentable explosive structure 10 efficiently utilizes the forces exerted by the explosive charge 13, in that the propelling forces are directed against the entire, inner side surfaces 33, 34 of both elongated members 23, 26 of each projectile 15, 15B, but the subsequent, retarding forces of adjacent relative airflow during flight are received only by the relatively small cross-sectional area of the projectiles in their aligned configurations. Moreover, in the preferred embodiment wherein the projectiles are initially constrained in contiguous alignment adjacent the explosive charge, substantially all the initial explosive forces are received by the projectiles rather than being lost through gaps or slots therebetween. Finally, because substantially all the projectiles achieve axial flight, the explosive fragmentation structure need not be manufactured with an excess size or capacity to compensate for those fragments which otherwise would not impinge axially upon the target.

While only one embodiment of the invention, together with modifications thereof, has been described in detail herein and shown in the accompanying drawing, it will be evident that various further modifications are possible in the arrangement and construction of its components without departing from the scope of the invention.

What is claimed is:

1. An explosive structure of the fragmentation type, comprising:

an explosive charge;

a housing containing the explosive charge and having a cylindrical wall portion extending peripherally of the explosive charge and comprising a plurality of articulated structures each having a first elongated member having first and second end portions and a second elongated member having first and second end portions, articulatory means interconnecting the respective first end portions of the first and second elongated members for permitting rotation of the elongated members from a diverged configuration, in which their respective end portions are mutually spaced, to an aligned configuration, in which their respective second end portions are mutually adjacent and in which the first and second elongated members are substantially parallel, and means for separably constraining the articulated structures in their diverged configuration and in an array in which their first and second elongated members extend along planes substantially perpendicular to the housing axis, each elongated member having a respective force receiving surface extending longitudinally of the member and facing toward the explosive charge, and an oppositely facing, outer surface; and means for detonating the explosive charge, whereby the resultant forces react against the force receiving surfaces of the elongated members to propel the articulated structures radially outwardly from the explosive charge, the articulated structures having means, including the outer surfaces of the elongated members, responsive to adjacent airflow during any such outwardly propelled flight for rotating the elongated members of the respective articulated members into their aligned position for permitting axial flight of the articulated structures.

2. The apparatus of claim 1, the means separably constraining the articulated structures comprising means separably constraining the articulated structures in contiguous alignment.

3. The apparatus of claim 1, the articulatory means comprising means preventing pivotal movement of the elongated members to a position in which their outer surfaces extend outwardly from the articulatory means to define an acute angle.

4. The apparatus of claim 1, the means separably constraining the articulated structures comprising means orienting the articulated structures with the end portions of the elongated members of circumferentially mutually adjacent articulated structures being in contiguous, axial alignment to form a length of mutually adjacent elongated members extending circumferentially of the explosive charge.

5. The apparatus of claim 4, wherein a plurality of lengths of elongated members extending circumferentially of the explosive charge are positioned in contiguous, mutual alignment along the axial length of the explosive charge.

6. The apparatus of claim 1, the elongated members having airfoil means adjacent their respective second end portions and projecting from their outer surfaces for both maintaining the articulated structures in their aligned position during flight and for stabilizing the articulated structures in axial flight.

7. The apparatus of claim 6, the airfoil means being of rectangular cross section and triangular longitudinal section.

8. The apparatus of claim 2, the articulatory means comprising means pivotally connecting the elongated members of respective articulated structures, the axes of the pivotal connections of the articulated structures extending parallel to the axis of the housing.

9. The apparatus of claim 8, wherein mutually adjacent articulated structures are in side-by-side alignment along the length of the housing and wherein the pivotal axes of respective articulated structures aligned along the length of the housing are in mutual alignment.

10. A fragmentation warhead comprising:

an explosive charge;

a housing containing the explosive charge and having at least one wall portion comprising a plurality of articulated structures each having a first elongated member having first and second end portions and a second elongated member having first and second end portions, articulatory means interconnecting the respective first end portions of the first and second elongated members for permitting rotation of the elongated members from a diverged configuration, in which their respective second end portions are mutually spaced, to an aligned configuration, in which their respective second end portions are mutually adjacent and in which the first and second elongated members are substantially parallel, and means for separably constraining the articulated structures in their diverged configuration, the elongated members having respective force receiving surfaces facing toward the explosive charge and respective, oppositely facing outer surfaces; and means for detonating the explosive charge, whereby the articulated structures are propelled outwardly from the warhead, the articulated structures having means responsive to adjacent airflow during any such outwardly propelled flight for rotating the elongated members of the respective articulated structures into their aligned position for permitting axial flight of the articulated structures.

11. The apparatus of claim 10, the elongated members having airfoil means adjacent their respective second end portions and projecting from their outer surfaces for both maintaining the articulated structures in their aligned position during flight and for stabilizing the articulated structures in axial flight.

12. The apparatus of claim 11, the airfoil means being of rectangular cross-section and rectangular longitudinal section.

13. The apparatus of claim 10, the means for separably constraining the articulated structures comprising means for separably constraining the elongated members in an array in which the elongated members are coincident, at their respective first and second end portions, with a cylindrical locus.

14. The apparatus of claim 10, the articulatory means comprising means pivotally connecting the respective first end portions of the first and second elongated members of the respective articulated structures.

15. The apparatus of claim 14, the articulatory means comprising means preventing pivotal movement of the elongated members to a position in which their outer surfaces extend outwardly from their articulatory means to define an acute angle.

16. The apparatus of claim 10, further comprising an outer housing means disposed alongside and externally of the at least one wall portion.

17. The apparatus of claim 10, at least one of the elongated members of the respective articulated structures having a deformable means for deformably reacting against the force receiving surface of the other elongated member upon the elongated members being rotated into their aligned position.

* * * * *